US008210905B2

(12) United States Patent
Sakairi

(10) Patent No.: US 8,210,905 B2
(45) Date of Patent: Jul. 3, 2012

(54) WAFER POLISHING DEVICE AND METHOD

(75) Inventor: Takashi Sakairi, Kanagawa (JP)

(73) Assignee: Sony Corporation, Tokyo (JP)

( * ) Notice: Subject to any disclaimer, the term of this patent is extended or adjusted under 35 U.S.C. 154(b) by 492 days.

(21) Appl. No.: 12/431,407

(22) Filed: Apr. 28, 2009

(65) Prior Publication Data

US 2009/0275269 A1 Nov. 5, 2009

(30) Foreign Application Priority Data

Apr. 30, 2008 (JP) ..... 2008-118404

(51) Int. Cl.
*B24B 1/00* (2006.01)

(52) U.S. Cl. ..... 451/44; 451/168; 451/296; 451/303; 451/310

(58) Field of Classification Search ..... 451/44, 451/303, 168, 310, 307, 296
See application file for complete search history.

(56) References Cited

U.S. PATENT DOCUMENTS 2,671,993 A * 3/1954 Jones et al. ..... 451/303
2,946,163 A * 7/1960 Ely ..... 451/537
4,858,265 A * 8/1989 Suzuki et al. ..... 15/100
5,733,181 A * 3/1998 Hasegawa et al. ..... 451/168
5,868,857 A * 2/1999 Moinpour et al. ..... 134/6
6,080,051 A * 6/2000 Weber ..... 451/303
6,402,596 B1 * 6/2002 Hakomori et al. ..... 451/44
6,475,293 B1 * 11/2002 Moinpour et al. ..... 134/6
6,558,239 B2 * 5/2003 Kunisawa et al. ..... 451/303
6,761,618 B1 * 7/2004 Leigh et al. ..... 451/11
7,066,787 B2 * 6/2006 Nakanishi et al. ..... 451/6
7,115,023 B1 * 10/2006 Owczarz ..... 451/44
7,367,873 B2 * 5/2008 Ishii et al. ..... 451/168

FOREIGN PATENT DOCUMENTS

JP 2001-345294 12/2001
JP 2003-163188 6/2003

* cited by examiner

*Primary Examiner* — George Nguyen
(74) *Attorney, Agent, or Firm* — SNR Denton US LLP

(57) ABSTRACT

Disclosed herein is a wafer polishing device including: an abrasive member driving device adapted to run a belt-like abrasive member in a direction crossing an outer circumferential end-edge of a wafer which is a wafer to be polished while bringing a belt-like abrasive member into contact with outer circumferential end-edge of the wafer, the abrasive member having non-abrasive sections disposed on both sides of an abrasive grain section; and a guide member having two guide surfaces shaped to conform to the outer circumferential end-edge of the wafer, the two guide surface being adapted to press, from rear sides of the non-abrasive sections, the respective non-abrasive sections of the abrasive member run by the abrasive member driving device.

8 Claims, 9 Drawing Sheets

Related Art

LOW-TENSION

HIGH-TENSION

Related Art

Related Art

WAFER POLISHING DEVICE AND METHOD

BACKGROUND OF THE INVENTION

1. Field of the Invention

The present invention relates to a wafer polishing device and method for polishing the outer circumferential end-edge of a wafer.

2. Description of the Related Art

In the semiconductor device manufacturing step, a front-surface condition of an outer circumferential end-edge portion (a chamfered portion of an end) called a bevel portion attracts attention in view of an improvement in yield. This is because unnecessary materials, damage, etc. left on the bevel portion fall away and adhere to the device front surface during undergoing various steps, which exerts a harmful influence on product yields.

Because of this, it have been proposed in recent years that polishing processing is performed on the bevel portion of a wafer as a sub-step of a semiconductor device manufacturing step to suppress the occurrence of foreign matter from the bevel portion. See e.g. Japanese Patent Laid-open No. 2001-345294.

As the polishing processing on the bevel portion of a wafer, a method is known of performing polishing processing on the bevel portion of a wafer using a belt-like (tape-like) abrasive film fixedly attached with abrasive grains. See Japanese Patent Laid-open No. 2003-163188.

SUMMARY OF THE INVENTION

Incidentally, the polishing processing on the outer circumferential end-edge (the bevel portion) of a wafer is desired to be performed at a low-load in order to achieve the high-accuracy of the polishing processing. It is difficult, however, for the method performed using the traditional abrasive film to perform the polishing processing at a low load for the reason described below.

If the polishing processing is performed on the bevel portion of the wafer using the abrasive film, to perform the polishing processing at a low load, it is conceivable to increase the contact area between the abrasive film and the bevel portion to thereby lower pressure per unit area.

To maintain an abrasive rate during polishing processing, however, it is necessary to run the abrasive film in a direction crossing the circumferential direction of the wafer bevel portion. More specifically, as illustrated in FIG. 8, it is necessary that a feed roll 13*a* and a recovery roll 13*b* for an abrasive film 12 are respectively disposed above and below a wafer 11 and the abrasive film 12 is moved downward or upward between the rolls 13*a* and 13*b*. Therefore, even if the abrasive film 12 is increased in widthwise size, the contact condition of the abrasive film 12 with the bevel portion of the wafer 11 depends on the shape of the supply roll 13*a* and of the recovery roll 13*b* as illustrated in FIG. 9A. In other words, it is not typically true that the increased widthwise size of the abrasive film 12 leads to the increased contact area therebetween. As shown in FIG. 9B, it is conceivable that a guide member 14 bending to follow the shape of the bevel portion of the wafer 11 is used to press the abrasive film 12 toward the wafer 11 from the rear side thereof. Taking into account a difference of the shape of the bevel portion due to the individual difference of the wafer 11, it is not typically true that the uniform pressurization can be performed. Consequently, it is likely not to achieve lowering of pressure per unit area.

To perform the polishing processing at a low load, it is conceivable that the pressurizing force of the abrasive film to the bevel portion of the wafer is reduced to lower pressure per unit area. More specifically, it is conceivable that without load application from the rear side of the abrasive film, polishing pressure is controlled by the tension of the abrasive film to reduce the pressurizing force of the abrasive film to the bevel portion of the wafer to thereby lower pressure per unit area.

However, in such a case where the polishing pressure is controlled by the tension of the abrasive film, as the tension is reduced, the force of the abrasive film to maintain the shape of feed roll 13*a* and of the recovery roll 13*b* is increased as illustrated in FIGS. 10A and 10B. Consequently, the abrasive film 12 will not follow the shape of the bevel portion of the wafer 11. In other words, if the polishing processing is to be performed at a low load, the contact area between the abrasive film 12 and the bevel portion of the wafer 11 becomes small. Consequently, it is likely not to be able to achieve the lowering of the pressure per unit area.

To reduce the pressurizing force of the abrasive film to the bevel portion of a wafer, the following is conceivable as illustrated in FIGS. 11A and 11B. A wafer 11 is placed on a table 15. An abrasive film 12 is brought into contact with the bevel portion of the wafer 11 which is a workpiece to be polished, and with one other than the to-be-polished workpiece, i.e., the outer circumferential end-edge of the table 15. Thus, pressure is dispersed to allow a polishing load to escape. It can be said, however, that this technique is not practical taking into account the following: The shape of the bevel portion of the wafer 11 and the size (outer diameter) of the wafer 11 have variations due to individual differences and the outer circumference of the wafer 11 is not typically a perfect circle.

It is desirable, therefore, to provide a wafer polishing device and method that can perform, even to perform polishing processing on the outer circumferential end-edge of a wafer which is a workpiece to be polished using a belt-like abrasive member represented by an abrasive film, the polishing processing at a low load, and that can improve the accuracy of load application control during the polishing processing, thereby achieving the higher-accuracy and higher-efficiency of the polishing processing.

According to an embodiment of the present invention, there is provided a wafer polishing device including: an abrasive member driving device adapted to run a belt-like abrasive member in a direction crossing an outer circumferential end-edge of a wafer which a wafer to be polished while bringing a belt-like abrasive member into contact with outer circumferential end-edge of the wafer, the abrasive member having non-abrasive sections disposed on both sides of an abrasive grain section; and a guide member having two guide surfaces shaped to conform to the outer circumferential end-edge of the wafer, the two guide surface being adapted to press, from rear sides of the non-abrasive sections, the respective non-abrasive sections of the abrasive member run by the abrasive member driving device.

In the wafer polishing device configured as above, the belt-like abrasive member having the non-abrasive sections disposed on both the sides of the abrasive grain section is brought into contact with the outer circumferential end-edge of the wafer. Specifically, since the non-abrasive sections as well as the abrasive grain section are brought into contact with the outer circumferential end-edge of the wafer, the contact area of the abrasive member with the outer circumferential end-edge of the wafer is increased according to the non-abrasive sections. In addition, when the abrasive member is brought into contact with the outer circumferential end-edge of the wafer, the two guide surfaces of the guide member press the respective rear surfaces of the non-abrasive sections of the abrasive member. Thus, the abrasive member is brought into contact with the outer circumferential end-edge while conforming to the shape of the outer circumferential end-edge of the wafer. In addition, since the abrasive grain section is not directly be pressed to the circumferential end-edge from the rear side thereof, the pressurizing force of the abrasive grain section does not become excessive.

According to the embodiment of the present invention, the increased contact area of the belt-like abrasive member with the outer circumferential end-edge of the wafer can lower pressure per unit area. The abrasive member conforming to the outer circumferential end-edge of the wafer can achieve the uniform pressurization of the abrasive member to the outer circumferential end-edge. Further, the pressurizing force of the abrasive grain section does not become excessive. Thus, even if the polishing processing is performed on the outer circumferential end-edge of the wafer which is a workpiece to be polished by use of the belt-like abrasive member, it can be done at a low load and the accuracy of load application control for the polishing processing can be improved. As a result, the higher-accuracy and efficiency of the polishing processing can be achieved.

DETAILED DESCRIPTION OF THE PREFERRED EMBODIMENTS

A wafer polishing device and method according to embodiments of the present invention will hereinafter be described with reference to the drawings.

First Embodiment

A description will first be given of a first embodiment of the present invention.

Figure 1:
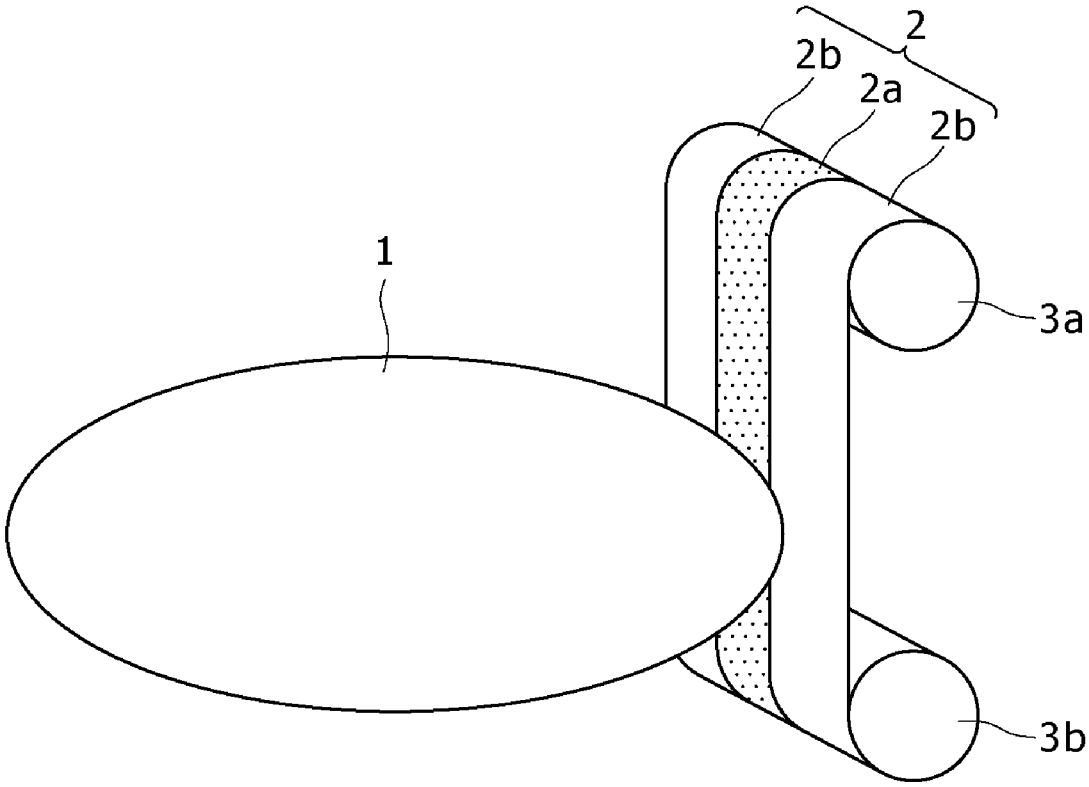
FIG. 1 is an explanatory view illustrating a schematic configurational example of a wafer polishing device according to a first embodiment of the present invention.
Figure 2:
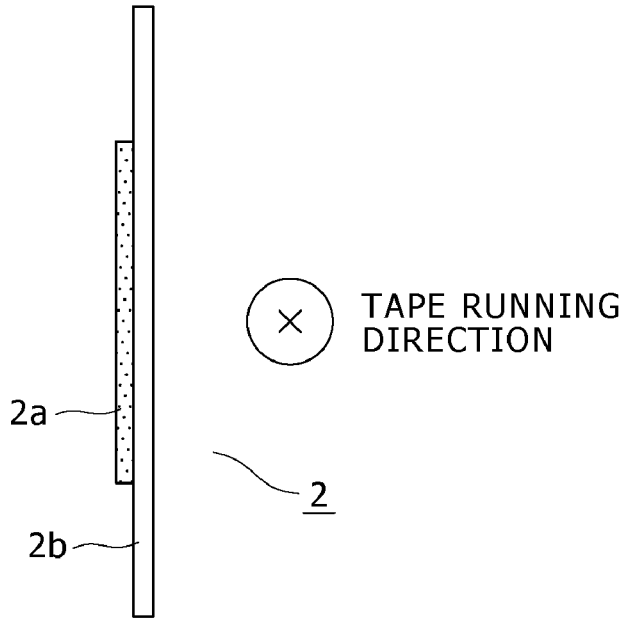
FIG. 2 is a partial cross-sectional view of an abrasive tape of the first embodiment.
Figure 3:
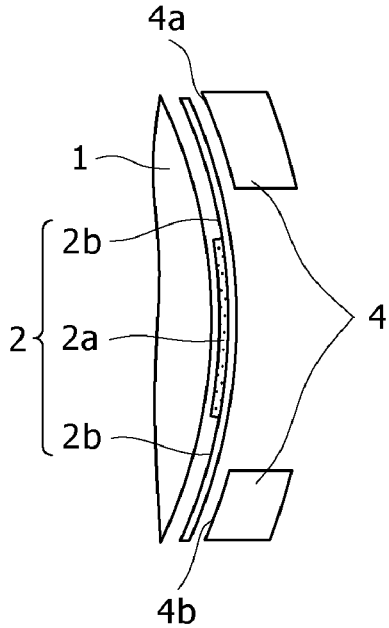
FIG. 3 is an enlarged cross-sectional view of the wafer polishing device of the first embodiment.

FIGS. 1 to 3 are explanatory views illustrating a schematic configurational example of a wafer polishing device according to the first embodiment.

Referring to FIG. 1, the wafer polishing device of the first embodiment is configured such that an abrasive tape 2 which is a belt-like polishing member is run in a direction crossing a bevel portion while being brought into contact with an outer circumferential end-edge (the bevel portion) of a wafer 1 which is a workpiece to be polished. More specifically, a feed roll 3*a* and a recovery roll 3*b* for the abrasive tape 2 are respectively arranged above and below the wafer 1. The abrasive tape 2 is moved upward or downward between the rolls 3*a*, 3*b*, i.e., in a direction vertical to the circumferential direction of the wafer 1. These rolls 3*a*, 3*b* achieve a function as a polishing member driving device by way of one specific example.

Referring to FIG. 2, the abrasive tape 2 includes an abrasive grain section 2*a* and non-abrasive sections 2*b*, which are arranged such that the non-abrasive sections 2*b* are respectively located on both sides of the abrasive grain section 2*a*.

The abrasive grain section 2*a* is a section located at the general widthwise-center of the abrasive tape 2 and formed of abrasive grains for polishing the bevel portion of the wafer 2*a*. Specifically, the abrasive grains forming the abrasive grain section 2*a* may be realized using the known technique as long as they are suitable to polish the bevel portion of the wafer 1. The forming material and method of the abrasive grains are not particularly restrictive.

The non-abrasive section 2*b* is a section formed of a base material of the abrasive tape 2. It is conceivable that the base material uses a polymer film made of e.g. a polyethylene terephthalate (PET) resin. In other words, the non-abrasive section 2*b* is a section where the front surface of the base material such as a PET film is exposed, that is, a section where the abrasive grains adapted to polish the bevel portion of the wafer 1 are not arranged.

It is conceivable that the abrasive tape 2 formed as above is formed by depositing an abrasive grain layer on the general widthwise center of the base material such as a PET film. In short, the abrasive tape 2 is integrally formed of the abrasive grain section 2*a* and the non-abrasive sections 2*b*.

The abrasive tape 2 formed by the deposition of the abrasive grain layer has such a step between the abrasive grain section 2*a* and each of the non-abrasive sections 2*b* as that the abrasive grain section 2*a* protrudes toward the bevel portion of the wafer 1 which is a workpiece to be polished. This step is specified by the layer-thickness of the abrasive grain section 2*a* and may conceivably be set at e.g. about 5 through 100 μm.

Referring to FIG. 3, the wafer polishing device includes a guide member 4 disposed on the rear side of the abrasive tape 2 running in the direction crossing the bevel portion of the wafer 1, i.e., on the side opposed to the bevel portion of the wafer 1 with the abrasive tape 2 put therebetween.

The guide member 4 is configured to include two guide surfaces 4*a*, 4*b* shaped to conform to the bevel portion of the wafer 1. The shape conforming to the bevel portion of the wafer 1 means a shape following the shape of the bevel portion, i.e., a shape curved to have almost the same diameter as that of the bevel portion with which the abrasive tape 2 is brought into contact. However, these two guide surfaces 4*a*, 4*b* are respectively located on the rear sides of the non-abrasive sections 2*b* of the abrasive tape 2 but not located on the rear side of the abrasive grain section 2*a*.

The guide member 4 having the two guide surfaces 4*a*, 4*b* as described above is disposed on the rear side of the abrasive tape 2. Thus, the wafer polishing device will be such that the two guide surfaces 4*a*, 4*b* of the guide member 4 press, from the rear side of the non-abrasive sections 2*b*, the non-abrasive sections 2*b* of the abrasive tape 2 running in the direction crossing the bevel portion of the wafer 1. It is to be noted that the press here means press adapted to allow the abrasive tape 2 to follow the shape of the bevel portion of the wafer 1 but not adapted to apply a load to the abrasive tape 2 in contact with the bevel portion.

A description is next given of an operational example of the wafer polishing device configured as above, i.e., of an embodiment of a wafer polishing method.

When the bevel portion of the wafer 1 is subjected to polishing while running the abrasive tape 2 in the direction crossing the bevel portion, it is preferable to perform the polishing processing at a low load to achieve the high-accuracy of the polishing processing. In addition, press may be applied toward the bevel portion of the wafer 1 from the rear side of the abrasive tape 2. In such a case, to make the pressurizing force small, it is conceivably preferable that the active pressurizing should not be done from the rear side but the guide surface be provided on the rear side of the abrasive tape 2 to guide the running of the abrasive tape 2.

To meet such a need, the wafer polishing device is such that the non-abrasive sections 2*b* containing no abrasive grains are provided in the respective widthwise side sections of the abrasive tape 2. While the bevel portion of the wafer 1 is not polished even by being pressed by the non-abrasive abrasive sections 2*b*, the rear sides of the non-abrasive sections 2*b* are guided by the two guide surfaces 4*a*, 4*b* of the guide member 4 in running the abrasive tape 2 in the direction crossing the bevel portion. This is because it is preferable that the abrasive tape 2 be allowed to follow the shape of the bevel portion of the wafer 1 which is a workpiece to be polished if the front surface of the bevel portion is a reference.

That is to say, when the bevel portion of the wafer 1 is subjected to the polishing processing by running the abrasive tape 2 in the direction crossing the bevel portion, the non-abrasive sections 2*b* located on both the sides of widthwise side portions of the abrasive tape 2 are held from their rear sides of the two guide surfaces 4*a*, 4*b* by those of the guide member 4. For this reason, the abrasive tape 2 can be made to follow the shape of the bevel portion at the contact portions between the abrasive tape 2 and the bevel portion of the wafer 1 while using the flexibility of the base material per se such as a PET film forming the abrasive tape 2. Consequently, the contact area between the abrasive tape 2 and the bevel portion of the wafer 1 can be increased to disperse the force applied to the bevel portion.

In this case, the two guide surfaces 4*a*, 4*b* are disposed to correspond to the respective non-abrasive sections 2*b* disposed to put the abrasive grain section 2*a* therebetween in the widthwise direction of the abrasive tape 2. In short, the guide surfaces x are disposed away from each other to have a separate distance therebetween. This separate distance shall be set taking into account the size of a notched portion of the wafer 1 which is a workpiece to be polished. Specifically, it is conceivable that the separate distance be made greater than the size of the notched portion of the wafer 1. This is because even if the notched portion is a portion to be polished for example, the two guide surfaces 4*a*, 4*b* are disposed to stride the notched portion to have no adverse influence on the vicinity of the end of the notched portion during the polishing.

Incidentally, the two guide surfaces 4*a*, 4*b* do not typically have to be separate ones. In other words, the guide member 4 having the two guide surfaces 4*a*, 4*b* may be a single piece.

On the other hand, the separate portion put between the two guide surfaces 4*a*, 4*b* have to be present. This is because no positive pressurization is given to the abrasive grain section 2*a* of the abrasive tape 2 located at a position corresponding to the separate portion.

As described above, in the first embodiment of the present invention, when the bevel portion of the wafer 1 is subjected to the polishing processing, the belt-like abrasive tape 2 having the non-abrasive sections 2*b* disposed on both the sides of the abrasive grain section 2*a* is brought into contact with the bevel portion. In other words, the non-abrasive sections 2*b* as well as the abrasive grain section 2*a* are brought into contact with the bevel portion of the wafer 1. Therefore, the contact area of the abrasive tape 2 to the bevel portion is increased according to the non-abrasive sections 2*b*. In addition, when the abrasive tape 2 is brought into contact with the bevel portion of the wafer 1, the two guide surfaces 4*a*, 4*b* of the guide member 4 press the non-abrasive sections 2*b* of the abrasive tape 2 from the rear sides thereof. Therefore, the abrasive tape 2 is brought into contact with the bevel portion of the wafer 1 while conforming to the shape of the bevel portion. In addition, the abrasive grain section 2*a* is not directly pressurized from the rear side thereof so that the pressurizing force of the abrasive grain section 2*a* will not become excessive.

Accordingly, in the first embodiment of the present invention, the contact area of the abrasive tape 2 with the bevel portion of the wafer 1 is increased to be able to lower pressure per unit area. The abrasive tape 2 is made to conform to the shape of the bevel portion of the wafer 1 to be able to achieve the uniform pressurization of the abrasive tape 2 to the bevel portion. Further, the pressurizing force of the abrasive grain section 2*a* of the abrasive tape 2 does not become excessive. Therefore, even if the belt-like abrasive tape 2 is used to perform the polishing processing on the bevel portion of the wafer 1 which is a workpiece to be polished, the polishing processing can be performed at a low load. In addition, the accuracy of load application control during the polishing processing can be improved. Thus, the higher accuracy and efficiency of the polishing processing can be achieved.

In the first embodiment of the present invention, the abrasive tape 2 has such a step between the abrasive grain section 2*a* and each of the non-abrasive grain sections 2*b* as that the abrasive grain section 2*a* protrudes toward the bevel portion of the wafer 1 which a workpiece to be polished. Therefore, the thickness of the abrasive grain section 2*a* is slightly greater than that of the non-abrasive section 2*b*. Thus, the two guide surfaces 4*a*, 4*b* of the guide member 4 press the respective non-abrasive sections 2*b* containing no abrasive grains, whereby they can satisfactorily press also the abrasive grain section 2*a* containing abrasive grains. In short, the pressurization to the abrasive grain section 2*a* can satisfactorily be carried out while avoiding the excessive pressurization thereto.

Further, in the first embodiment of the present invention, the abrasive grain section 2*a* and non-abrasive grain sections 2*b* of the abrasive tape 2 are formed as a single piece. Therefore, if the feed roll 3*a* and recovery roll 3*b* for the abrasive tape 2 are respectively arranged above and below the wafer 1, the abrasive tape 2 can be run in the direction crossing the bevel portion of the wafer 1. Specifically, even if the abrasive tape 2 configured to have the abrasive grain section 2*a* and the non-abrasive grain sections 2*b* is used to achieve the low-load application of the polishing processing on the bevel portion of the wafer 1, since the abrasive grain section 2*a* and the non-abrasive grain sections 2*b* are formed as a single piece, the device configuration can be simplified compared with the case where they are run separately from each other.

Second Embodiment

A description is next given of a second embodiment of the present invention.

Figure 4:
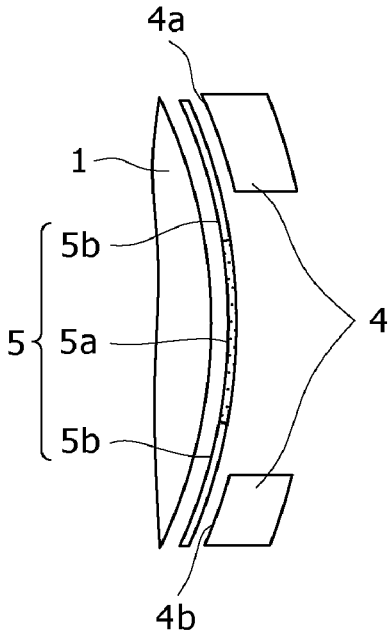
FIG. 4 is an explanatory view illustrating a schematic configurational example of a wafer polishing device according to a second embodiment of the present invention.

FIG. 4 is an explanatory view illustrating a schematic configurational example of a wafer polishing device according to the second embodiment. An abrasive tape 5 of the wafer polishing device in the figure is different from that of the first embodiment described above.

Similarly to the first embodiment, the abrasive tape 5 has an abrasive grain section 5*a* and non-abrasive sections 5*b*. The non-abrasive sections 5*b* are located on both sides of the abrasive grain section 5*a*. In addition, the abrasive grain section 5*a* and the non-abrasive sections 5*b* are formed as a single piece.

However, unlike the first embodiment, the abrasive tape 5 is such that the non-abrasive section 5*b* is formed of a base material made of a soft material such as nonwoven cloth and abrasive grains are impregnated into the base material to form the abrasive grain section 5*a*.

If the abrasive tape 5 formed as above is used to perform polishing processing on the bevel portion of the wafer 1, pressure can be applied with ease. In addition, since the abrasive tape 5 has the base material such as unwoven cloth which is a soft material, pressure can easily be dispersed at the contact portion between the abrasive tape 5 and the bevel portion. Consequently, lower-load application can reliably be achieved during the polishing processing on the bevel portion of the wafer 1.

Third Embodiment

A description is next given of a third embodiment of the present invention.

Figure 5:
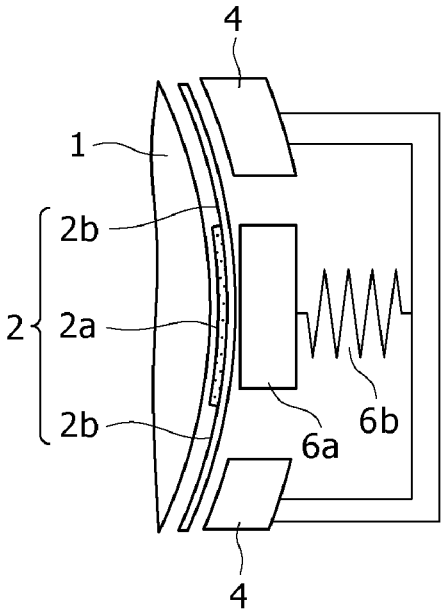
FIG. 5 is an explanatory view illustrating a schematic configurational example of a wafer polishing device according to a third embodiment of the present invention.

FIG. 5 is an explanatory view illustrating a schematic configurational example of a wafer polishing device according to the third embodiment.

In the configurational example of the first embodiment described above, the excessive pressurizing force of the abrasive grain section 2*a* is avoided without directly applying pressure to the abrasive grain section 2*a* from the rear side thereof. However, in the configurational example described here, a pressurizing plate 6*a* is disposed on the rear side of the abrasive grain section 2*a* and a pressure control mechanism 6*b* for the pressurizing plate 6*a* is provided on the rear side of the pressurizing plate 6*a*. This is different from the first or second embodiment.

The pressurizing plate 6*a* is not particularly restricted as long as it is a plate-like member capable of applying pressure to the abrasive grain section 2*a*. Also the pressure control mechanism 6*b* may be put into practice by use of a traditional technology such as controlling pressure using pneumatic or hydraulic pressure or the like.

The shape of the bevel portion of the wafer 1 and the size (the outside diameter) of the wafer 1 may cause variations due to e.g. the individual difference of the wafer 1. Even in such a case, the provision of such a pressurizing plate 6*a* and a pressure control mechanism 6*b* can adjust pressurizing force from the rear side of the abrasive grain section 2*a* into a predetermined level via the pressure control by the pressure control mechanism 6*b*. Thus, irrespective of the individual difference of the wafer 1 lower-load application can appropriately be achieved during the polishing processing on the bevel portion of the wafer 1.

Fourth Embodiment

A description is next given of a fourth embodiment of the present invention.

Figure 6B:
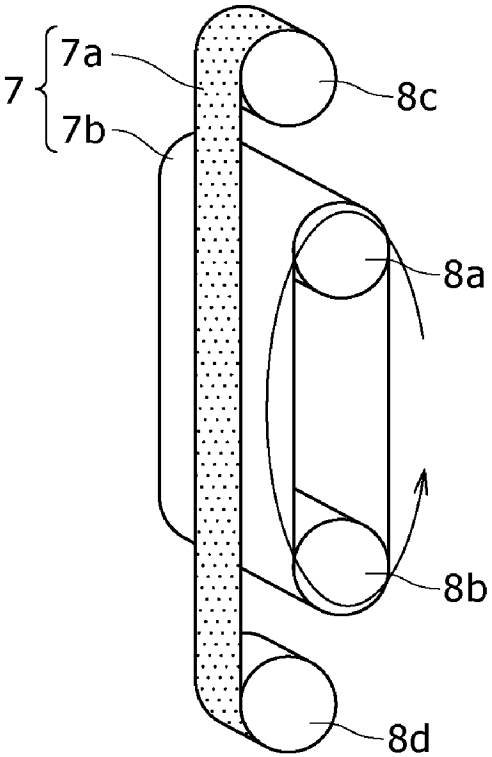
FIGS. 6A and 6B are explanatory views illustrating a schematic configurational example of a wafer polishing device according to a fourth embodiment of the present invention.
Figure 6A:
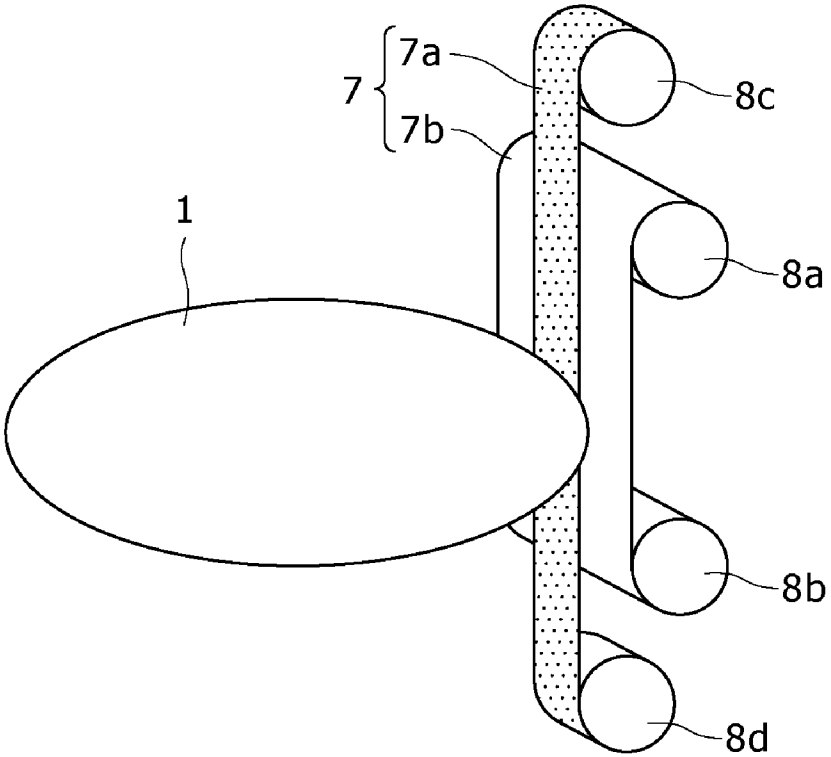

FIGS. 6A and 6B are explanatory views illustrating a schematic configurational example of a wafer polishing device according to the fourth embodiment. The wafer polishing device in the figure is different from that of each of the first through fourth embodiments in that an abrasive grain section 7*a* and a non-abrasive section 7*b* constituting an abrasive tape 7 are formed separately from each other.

More specifically, as illustrated in FIG. 6A, the abrasive tape 7 is composed of the abrasive grain section 7*a* and the non-abrasive section 7*b*. The abrasive tape 7 is common to each of the first through fourth embodiments in that the non-abrasive section 7*b* is located on each side of the abrasive grain section 7*a* at a contact portion with the bevel portion of the wafer 1. However, unlike the first through fourth embodiments, the abrasive grain section 7*a* is run in a direction crossing the bevel portion of the wafer 1 while being supported by a feed roll 8*c* and a recovery roll 8*d* for the abrasive grain section 7*a*. The non-abrasive section 7*b* is run in the direction crossing the bevel portion of the wafer 1 while being supported by a feed roll 8*a* and a recovery roll 8*b* for the non-abrasive section 7*b* prepared additionally to the feed roll 8*c* and recovery roll 8*d* for the abrasive grain section 7*a*.

As described above, the abrasive grain section 7*a* and the non-abrasive section 7*b* are not formed as a single piece but formed separately from each other. Therefore, for example, the abrasive grain section 7*a* and the non-abrasive section 7*b* can use respective existing products. Consequently, the formation of the abrasive tape 7 per se can be facilitated.

Further, since the non-abrasive section 7*b* is desired merely to function as a guide adapted to simply disperse pressure, an advantage can be provided that the non-abrasive section 7*b* can repeatedly be used, i.e., can be reused.

Incidentally, if the non-abrasive section 7*b* is reused, it is conceivable that the starting point and ending point of the non-abrasive section 7*b* are joined together to form a roll of the non-abrasive section 7*b* as illustrated in FIG. 6B. With this, it can be achieved that the non-abrasive section 7*b* with a short length is repeatedly used.

Fifth Embodiment

A description is next given of a fifth embodiment of the present invention.

Figure 7B:
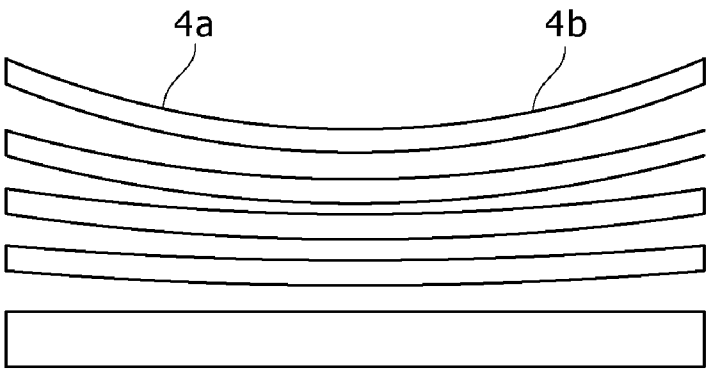
FIGS. 7A and 7B are explanatory views illustrating a schematic configurational example of a wafer polishing device according to a fifth embodiment of the present invention.
Figure 7A:
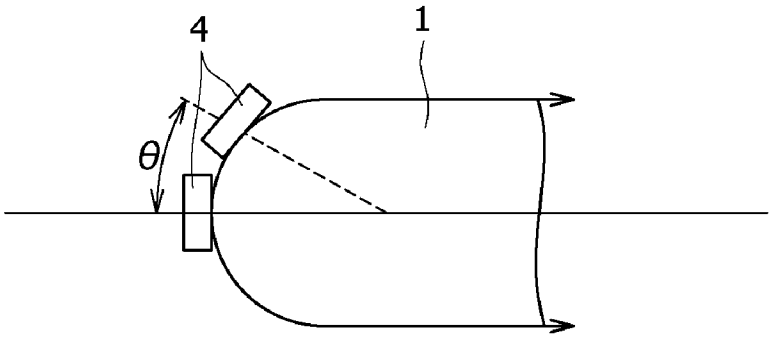
Figure 8:
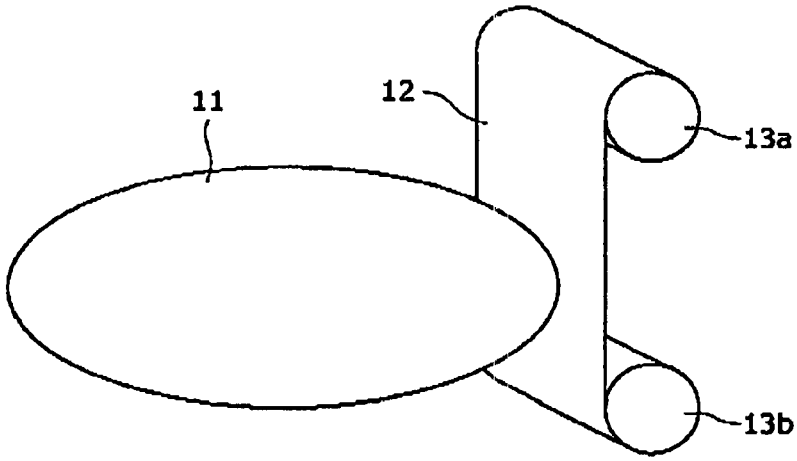
Related Art FIG. 8
FIG. 8 is an explanatory view illustrating a schematic configurational example of a traditional wafer polishing device.
Figure 9A:
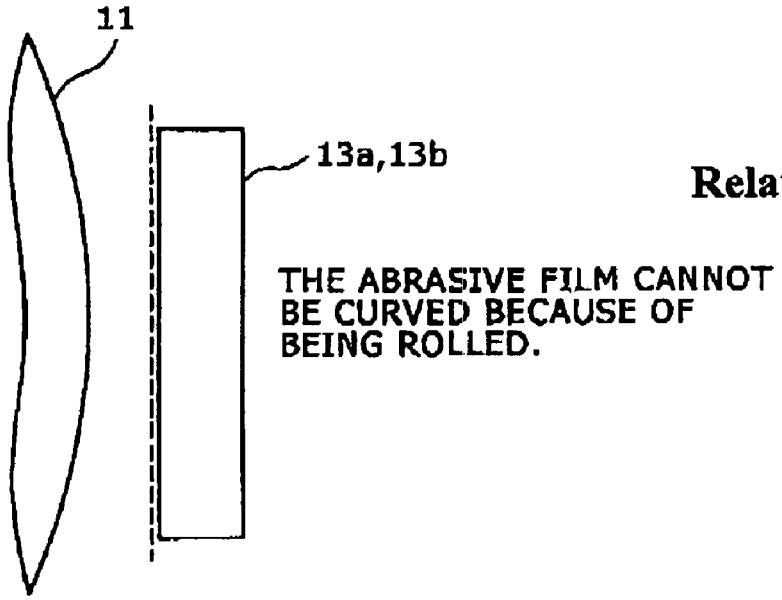
FIGS. 9A and 9B are explanatory views illustrating schematic configurational example of traditional wafer polishing devices.
Figure 9B:
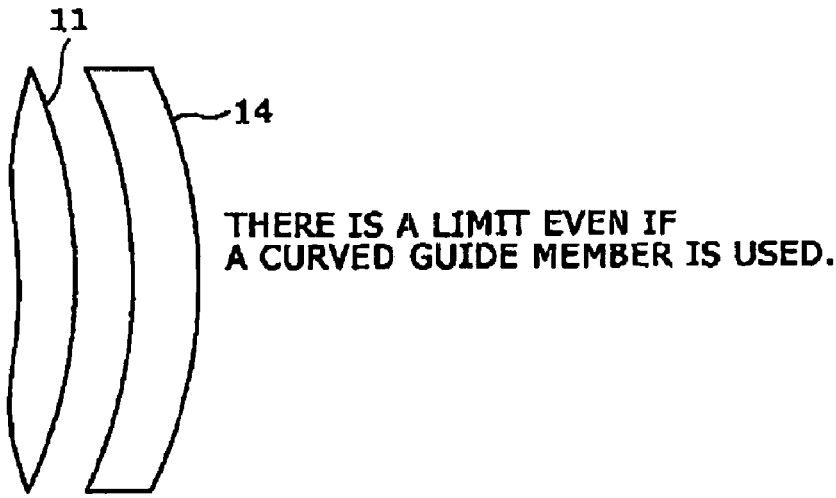
Related Art FIG. 9B
Figure 10B:
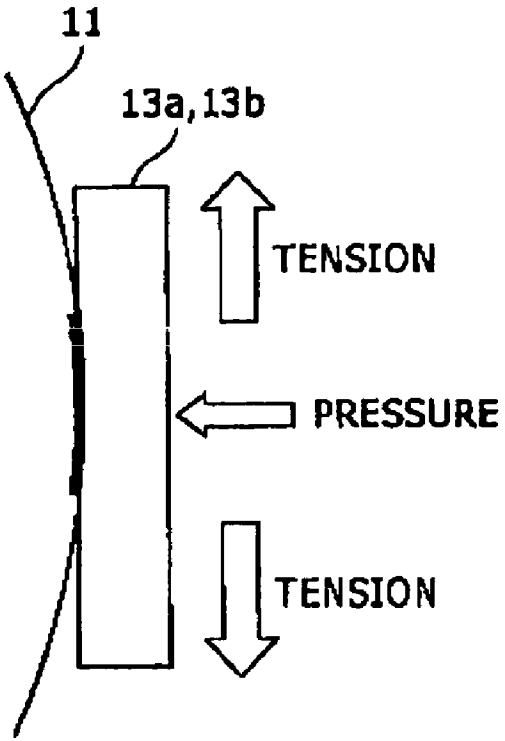
FIGS. 10A and 10B are explanatory views illustrating schematic configurational example of traditional wafer polishing devices.
Figure 10A:
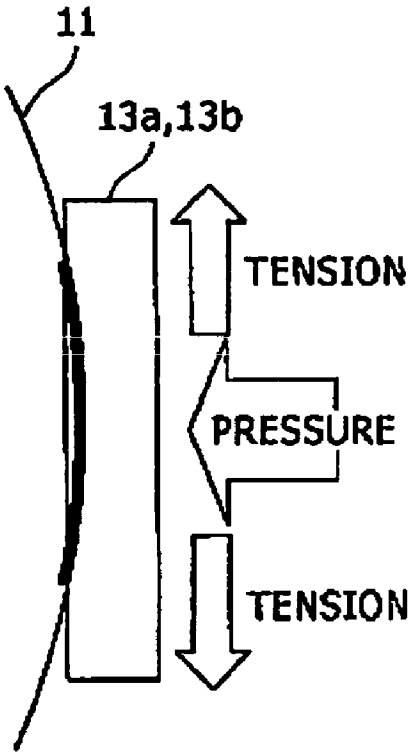
Related Art FIG.10A
Figure 11A:
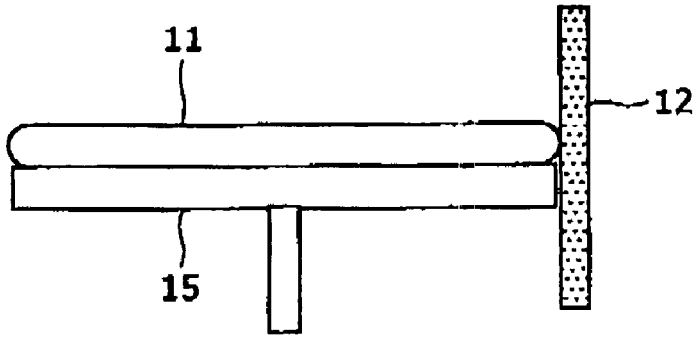
FIGS. 11A and 11B are explanatory views illustrating a schematic configurational example of a traditional wafer polishing device.
Figure 11B:
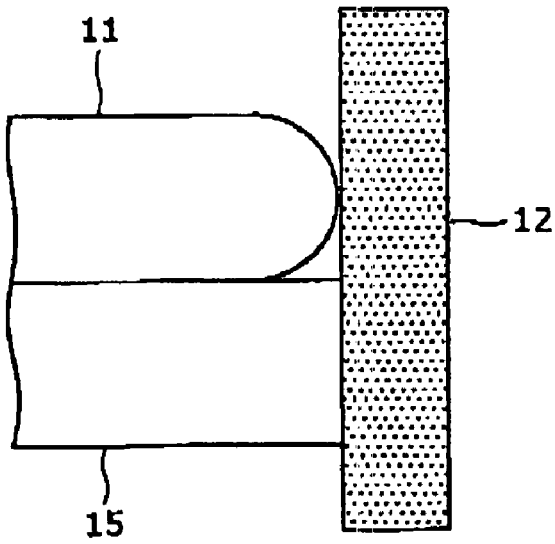
Related Art FIG.11B

FIGS. 7A and 7B are explanatory views illustrating a schematic configurational example of a wafer polishing device according to the fifth embodiment.

The polishing processing on the bevel portion of a wafer 1 may conceivably be desired to be performed not only on the outermost circumferential end-edge but also on the top side (a position shifted toward the upper surface of the wafer 1 by an angle of e.g.) or on the bottom side opposite thereto as illustrated in FIG. 7A.

To deal with this, it is conceivable to provide a swing device for swinging a guide member 4 located on the rear side of the abrasive tape to vary the contact position of the abrasive tape with the bevel portion of the wafer 1. More specifically, the guide member 4 is swung to vary the contact position of the abrasive tape with the bevel portion of the wafer 1 not only to the outermost circumferential end-edge of the bevel portion but also to the top side or the bottom side. Incidentally, the swing device for swinging the guide member 4 may be put into practice using a publicly known technology such as using a link mechanism swingably supporting the guide member 4 and a drive source such as a motor or an electromagnetic solenoid. With that, the detailed description thereof is omitted.

However, in the case where the guide member 4 is swung to vary the contact position with the bevel portion of the wafer 1, the shapes of the guide surfaces 4*a*, 4*b* of the guide member 4 may be allowed to conform to merely the outermost circumferential end-edge. In such a case, when the contact position is shifted to the top side or to the bottom side, the shapes of the guide surfaces 4*a*, 4*b* may be likely not to conform to the bevel portion of the wafer 1. This is because since a diameter from the center of the wafer 1 is different between the outermost circumferential end-edge of the bevel portion of the wafer 1 and a top side position inclined by an angle of also the curved shape will differ therebetween as illustrated in e.g., FIG. 7A.

Consequently, if the swinging device is configured to swing the guide member 4, the guide surfaces 4*a*, 4*b* of the guide member 4 are each formed to have such a surface as to conform to the shape of the bevel portion of the wafer 1 even after the guide member 4 has been swung. Further specifically, the guide member 4 is swung to shift the contact position of the bevel portion of the wafer 1 with each of the guide surfaces 4*a*, 4*b* in the thickness-direction (the up-down direction in the figure) of the wafer 1. Therefore, the guide surfaces 4*a*, 4*b* are each formed to differ in curved shape depending on the position of the thickness-direction as illustrated in FIG. 7B.

Even in the case where the polishing processing is performed not only on the outermost end-edge of the bevel portion of the wafer 1 but also on the top side or the bottom side, the guide surfaces 4*a*, 4*b* shaped to conform to the top side or the bottom side press the abrasive tape from the rear side thereof. Thus, the increased abrasive efficiency of the polishing processing can be achieved while improving the accuracy of load application control performed during the low-load polishing processing.

While the first through fifth embodiments describe the preferred specific examples of the present invention, the invention is not limited to the contents thereof. In other words, the present invention is not limited by the contents described in the embodiments described above but can be modified in the scope not departing from the gist thereof.

The present application contains subject matter related to that disclosed in Japanese Priority Patent Application JP 2008-118404 filed in the Japan Patent Office on Apr. 30, 2008, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. A wafer polishing device comprising:

an abrasive member driving device adapted to move an abrasive member in a direction crossing an outer circumferential end-edge of a wafer to be polished while bringing the abrasive member into contact with the outer circumferential end-edge of the wafer, the abrasive member having non-abrasive sections disposed on opposite sides of an abrasive grain section; and a guide member having two guide surfaces shaped to conform to a shape of the outer circumferential end-edge of the wafer, the two guide surfaces being adapted to press the non-abrasive sections against the circumferential end-edge of the wafer from rear sides of the non-abrasive sections.

2. The wafer polishing device according to claim 1, wherein the abrasive member has a step formed between the abrasive grain section and each non-abrasive section such that the abrasive grain section protrudes farther toward the outer circumferential end-edge of the wafer than do the non-abrasive sections.

3. The wafer polishing device according to claim 1, wherein the abrasive member is such that the abrasive grain section and the non-abrasive sections are a unitary member.

4. The wafer polishing device according to claim 1, wherein the abrasive member is such that the abrasive grain section and the non-abrasive sections are formed separately from each other.

5. The wafer polishing device according to claim 1, further comprising:

a swinging device adapted to swing the guide member to vary a contact position of the abrasive member with the outer circumferential end-edge of the wafer;

wherein the two guide surfaces of the guide member are each shaped to conform to the outer circumferential end-edge of the wafer even after the guide member has been swung by the swinging device.

6. A wafer polishing method comprising the steps of:

moving an abrasive member in a direction crossing an outer circumferential end-edge of a wafer to be polished while bringing the abrasive member into contact with the outer circumferential end-edge of the wafer, the abrasive member having non-abrasive sections disposed on opposite sides of an abrasive grain section; and applying pressure, from rear sides of the non-abrasive sections, to the non-abrasive sections using two guide surfaces shaped to conform to the shape of the outer circumferential end-edge of the wafer.

7. The wafer polishing device of claim 1, wherein the abrasive member comprises an elongated belt.

8. The wafer polishing method of claim 6, wherein the abrasive member comprises an elongated belt.

* * * * *